US009342029B1

(12) United States Patent
Tabata

(10) Patent No.: US 9,342,029 B1
(45) Date of Patent: May 17, 2016

(54) IMAGE FORMING APPARATUS THAT FORMS AN IMAGE WITH A DECOLORABLE MATERIAL AND A NON-DECOLORABLE MATERIAL AND METHOD FOR FORMING THE IMAGE

(71) Applicants: KABUSHIKI KAISHA TOSHIBA, Tokyo (JP); TOSHIBA TEC KABUSHIKI KAISHA, Tokyo (JP)

(72) Inventor: Sunao Tabata, Sunto Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/869,446

(22) Filed: Sep. 29, 2015

(51) Int. Cl.
*G03G 15/01* (2006.01)
*G03G 15/00* (2006.01)

(52) U.S. Cl.
CPC ..... *G03G 15/6585* (2013.01)

(58) Field of Classification Search
CPC ..... G03G 2215/0161; G03G 15/5058; G03G 15/0131; G03G 15/0189; G03G 15/0194; G03G 2215/0158; G03G 15/6585; G03G 15/1605; G03G 2215/00059; G03G 2215/00063
USPC ..... 399/40
See application file for complete search history.

(56) References Cited

U.S. PATENT DOCUMENTS

2010/0104967 A1* 4/2010 Ikeda ..... G03G 9/08755 430/108.23
2010/0196063 A1 8/2010 Iguchi et al.
2011/0143274 A1* 6/2011 Iftime ..... G03G 9/0804 430/108.2
2011/0177263 A1* 7/2011 Hasegawa ..... G03G 5/0611 428/29
2012/0082484 A1* 4/2012 Shimmura ..... G03G 15/0126 399/223
2012/0327481 A1* 12/2012 Yamauchi ..... G06K 15/02 358/3.28

FOREIGN PATENT DOCUMENTS

JP 2011053591 A * 3/2011

OTHER PUBLICATIONS

U.S. Appl. No. 14/313,304, filed Jun. 24, 2014.
U.S. Appl. No. 14/452,400, filed Aug. 5, 2014.

* cited by examiner

*Primary Examiner* — Francis Gray
(74) *Attorney, Agent, or Firm* — Patterson & Sheridan, LLP

(57) ABSTRACT

An image forming apparatus includes a first image forming unit configured to form a first image with a decolorable material and a second image forming unit configured to form a second image with a non-decolorable material. A color state of the decolorable material changes from a first color state to a second color state when a temperature thereof increases from a room temperature to a human body temperature, and from the second color state to the first color state when the temperature thereof decreases from the human body temperature to the room temperature. The first image overlaps with at least a portion of the second image.

19 Claims, 9 Drawing Sheets

```
/Times-New Roman findfont 10 scalefont setfont
(100,100)moveto
(ABCDE)show
/Times-New Roman-Bold findfont 10 scalefont setfont
(100,200)moveto
(FGHIJ)show
```

IMAGE FORMING APPARATUS THAT FORMS AN IMAGE WITH A DECOLORABLE MATERIAL AND A NON-DECOLORABLE MATERIAL AND METHOD FOR FORMING THE IMAGE

FIELD

Embodiments described herein relate generally to an image forming apparatus and an image forming method.

BACKGROUND

One type of image forming apparatus of the related art forms an image using a decolorable material. A color state of the decolorable material depends on a temperature of the decolorable material. For example, the decolorable material may be in a chromatic state similarly to a non-decolorable material when the image formed therewith is in use, and may turn into an achromatic state when the decolorable material is heated to a certain temperature or above.

Applying such a decolorable material to a variety of image forming operations is desirable.

DETAILED DESCRIPTION

The image forming apparatus according to an embodiment includes a first image forming unit configured to form a first image with a decolorable material and a second image forming unit configured to form a second image with a non-decolorable material. A color state of the decolorable material changes from a first color state to a second color state when a temperature thereof increases from a room temperature to a human body temperature, and from the second color state to the first color state when the temperature thereof decreases from the human body temperature to the room temperature. The first image overlaps with at least a portion of the second image.

Hereinafter, an image forming system 100 and an image forming apparatus 200 according to an embodiment will be described with reference to drawings. In addition, in each drawing, the same numeral is used for the same configuration.

Figure 1:
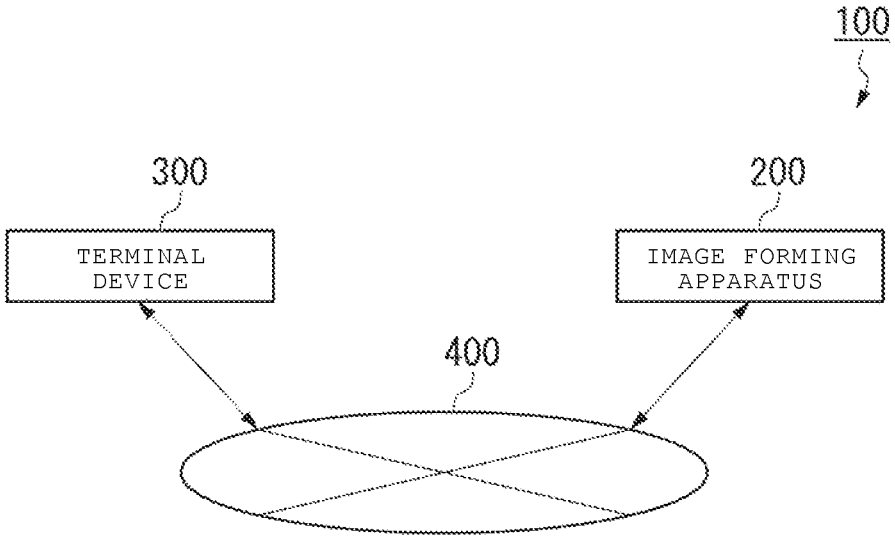
FIG. 1 is a block diagram of an image forming system according to an embodiment.

FIG. 1 is a block diagram of an entire configuration of the image forming system 100 according to the present embodiment.

As illustrated in FIG. 1, the image forming system 100 includes the image forming apparatus 200 and a terminal device 300. The image forming apparatus 200 and the terminal device 300 communicate with each other through a network 400.

The terminal device 300 is, for example, a personal computer, a portable information terminal device, or the like. The terminal device 300 transmits image data regarding an image to be formed by the image forming apparatus 200, instruction data regarding the image forming, or the like to the image forming apparatus 200.

Figure 2:
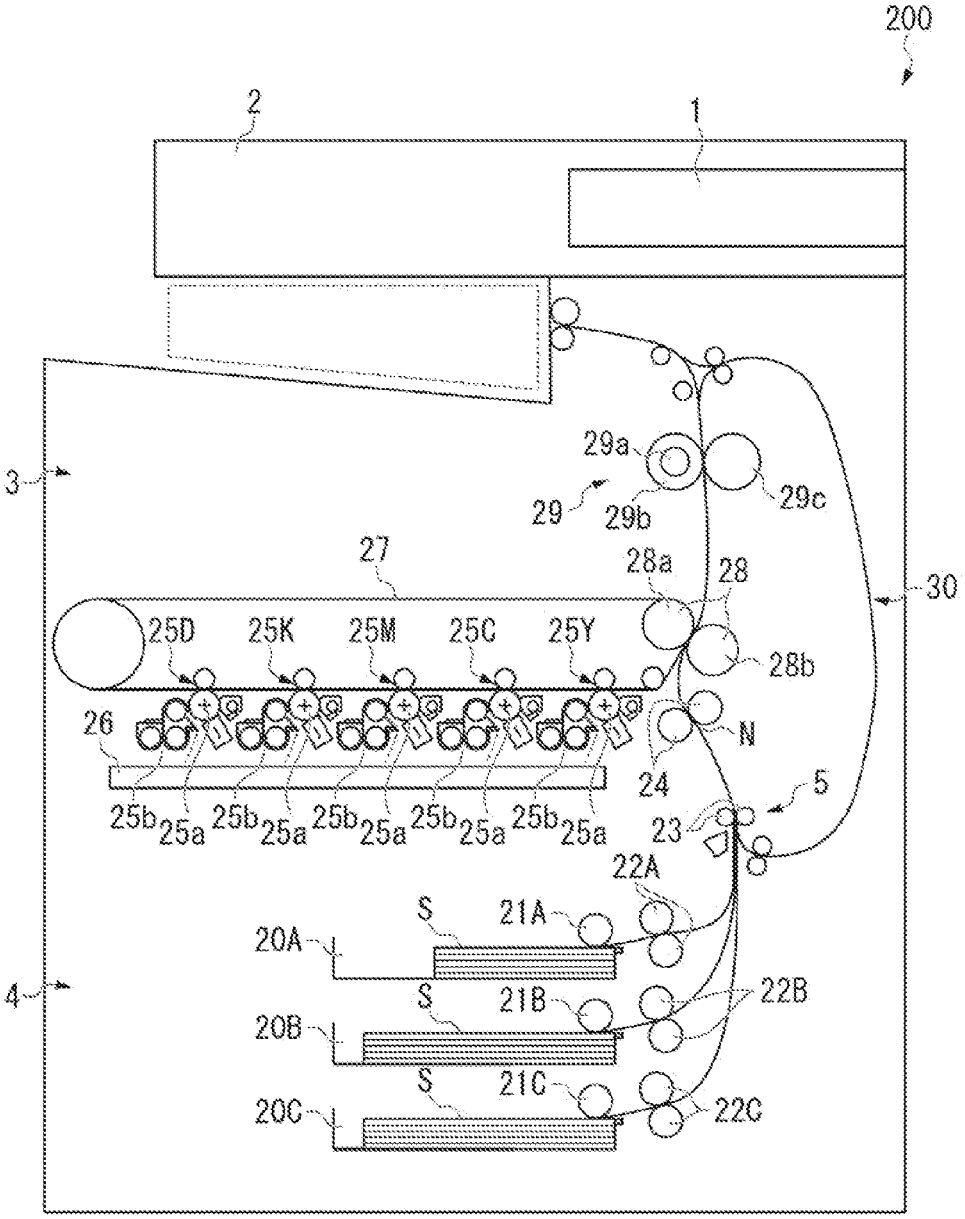
FIG. 2 schematically illustrates an image forming apparatus in the image forming system.

FIG. 2 schematically illustrates the image forming apparatus 200 according to the embodiment.

As illustrated in FIG. 2, the image forming apparatus 200 includes a control panel 1, a scanning unit 2, a printing unit 3, a sheet storage unit 4, and a transfer unit 5.

The scanning unit 2 scans copying target image based on an intensity of light reflected thereby and generates image data of the image. The scanning unit 2 then outputs the image data to the printing unit 3.

The printing unit 3 forms an image (toner image) using a developer including a toner, based on the image data transmitted from the scanning unit 2 or an external device. The printing unit 3 transfers a toner image to the surface of a sheet S. The printing unit 3 fixes the toner image on the sheet S by applying heat and pressure to the toner image on the surface of the sheet S.

The sheet storage unit 4 supplies the sheet S one by one to the printing unit 3 at the timing when the printing unit 3 forms a toner image. The sheet storage unit 4 includes a plurality of paper feed cassettes 20A, 20B, and 20C. The paper feed cassettes 20A, 20B, and 20C respectively store sheet S of predetermined size and type. The paper feed cassettes 20A, 20B, and 20C respectively include pickup rollers 21A, 21B, and 21C. The pickup rollers 21A, 21B, and 21C takes out the sheet S one by one from the paper feed cassettes 20A, 20B, and 20C, respectively. The pickup rollers 21A, 21B, and 21C convey the sheet S that is taken out to the transfer unit 5.

The transfer unit 5 includes a transfer roller 23 and a resist roller 24. The transfer unit 5 transfers the sheet S conveyed from the pickup rollers 21A, 21B, and 21C to the resist roller 24. The resist roller 24 conveys the sheet S according to a timing when the printing unit 3 transfers a toner image on the sheet S. The transfer roller 23 conveys the sheet S, such that a tip end thereof in the direction of a sheet conveying direction hits a nip N of the resist roller 24. The transfer roller 23 aligns the position of the tip end of the sheet S by bending the sheet S. The resist roller 24 transfers the sheet S to a transfer unit 28 after adjusting the tip end of the sheet S conveyed from the transfer roller 23 at the nip N.

The printing unit 3 includes a plurality of image forming units 25Y, 25M, 25C, 25K, and 25D, an exposing unit 26, an intermediate transfer belt 27, the transfer unit 28, and a fixing unit 29.

Each of the plurality of image forming units 25Y, 25M, 25C, 25K, and 25D forms a toner image formed on the sheet S. Each of the image forming units 25Y, 25M, 25C, 25K, and 25D includes a photoreceptor drum (image carrier) 25*a*. Further, each of image forming units 25Y, 25M, 25C, 25K, and 25D includes a developing device 25*b* that selectively supplies a toner to the surface of the corresponding photoreceptor drums 25*a*. The developing devices 25*b* contain non-decolorable toners of yellow, magenta, cyan, and black along with a decolorable toner. The decolorable toner is decolored at a temperature higher than a certain decoloring temperature. The decolorable toner has, in a colored state (chromatic state), for example, a color that is the same as that of a non-decolorable black toner or a color denser than the non-decolorable black toner.

Figure 3:
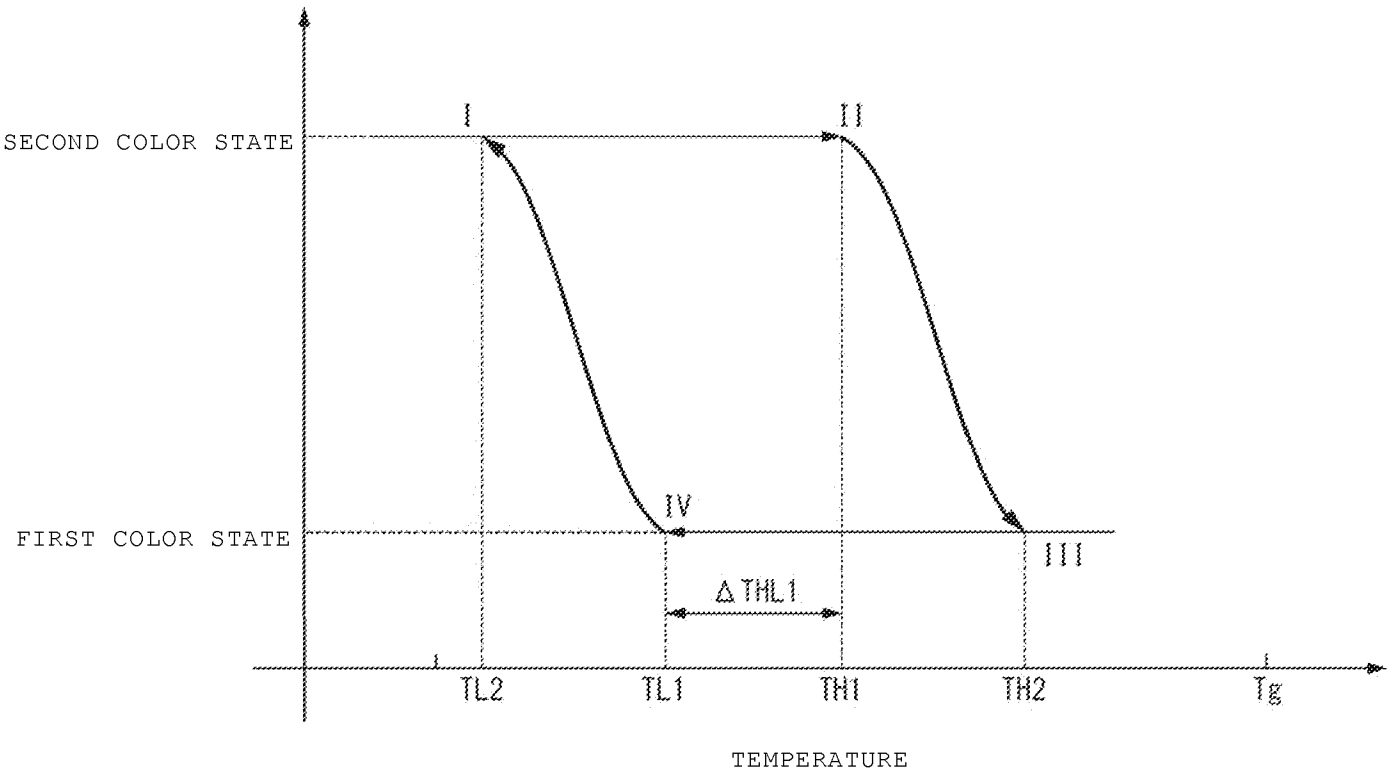
FIG. 3 illustrates a relationship between temperatures and color states of a coloring agent included in a decoloring toner used in the image forming apparatus according to the embodiment.

FIG. 3 illustrates a relationship between temperatures and color states of a coloring agent that is used in a decolorable toner according to the embodiment. The decolorable toner contains a binder resin and a coloring agent. The color state of the coloring agent used in the decolorable toner reversibly changes between a first color state and a second color state in accordance with a temperature change. The relationship between the temperatures and the color states of the coloring agent used in the decolorable toner draws a hysteresis loop. The hysteresis loop means that the relationship draws a closed loop when the temperature is raised or lowered within a certain scope. In FIG. 3, a horizontal axis indicates temperature and a vertical axis indicates a color state. The color state is, for example, at least one of brightness, hue, and intensity. At least one of brightness, hue, and intensity is different from the first color state and the second color state. The first color state is, for example, a decolored state (achromatic state). The second color state is, for example, a non-decolored state. The decolored state is a state in which a coloring agent does not generate a color. Decoloring allows an image having a color different from the color of the sheet S to be invisible. The color different from the color of the sheet S includes a chromatic color or achromatic colors including white, black, and the like.

In FIG. 3, a temperature TL1 is a temperature at which the color state of a coloring agent starts to change from the first color state to the second color state. A temperature TL2 is a temperature at which the color state of the coloring agent completely becomes the second color state. A temperature TH1 is a temperature at which the color state of the coloring agent starts to change from the second color state to the first color state. A temperature TH2 is a temperature at which the color state of the coloring agent completely becomes the first color state. A temperature Tg is a glass transition temperature of a binder resin.

The temperatures TH1, TH2, TL1, TL2, and Tg satisfy a relation of a formula (1) described below.

$$Tr<TL2<TL1<TH1<TH2<Tg \quad \text{formula (1)}$$

In FIG. 3, a temperature difference ΔTHL 1 is a difference between the temperature TH1 and the temperature TL1. A range I is a temperature range in which a coloring agent completely is in the second color state and that is equal to or lower than the temperature TL2. A range II is a temperature range from the temperature TL2 to the temperature TH1 at which the color state of the coloring agent starts to change from the second color state to the first color state. A range III is a temperature range in which the coloring agent is completely in the first color state and that is equal to or higher than the temperature TH2. A range IV is a temperature range from the temperature TH2 to the temperature TL1 at which the color state of the coloring agent starts to change from the first color state to the second color state.

The temperature TH1 is, for example, a temperature lower than a human body temperature. The temperature TH1 is, for example, 33° C. or the like. The temperature TH2 is, for example, a temperature approximate to the human body temperature. The temperature TH2 is, for example, 34° C. or the like. The temperature TL1 is, for example, approximately 28° C. to 30° C. The temperature TL2 is, for example, approximately 27° C. to 28° C. The decolorable toner becomes the first color state (decolored state) at a temperature equal to or higher than the human body temperature. The decolorable toner becomes the second color state (colored state) at a temperature lower than the human body temperature. The decolorable toner is, for example, becomes the first color state (decolored state) at 35° C. or higher and becomes the second color state (colored state) at 25° C. or lower.

The temperature range of the hysteresis loop is 30° C. or less, or more preferably, 10° C. or less. In the decolorable toner, when the temperature rang of the hysteresis loop is 30° C. or less, the temperature at which the decoloring toner completely becomes the first color state (decolored state) is approximately 50° C. or less. When the decolorable toner completely becomes the second color state (colored state), the temperature of the decolorable toner is, for example, 20° C. When the temperature range of the hysteresis loop is 30° C. or lower, the decoloring toner is likely to change between the first color state and the second color state. That is, when the temperature range of the hysteresis loop is 30° C. or lower, the color state of the decolorable toner is likely to change between the first color state and the second color state according to the change of the human body temperature. When the temperature range of the hysteresis loop is 10° C. or lower, the decolorable toner is more likely to change between the first color state and the second color state. When the temperature range of the hysteresis loop is higher than 30° C., the decolorable toner is unlikely to change between the first color state and the second color state. That is, when the temperature range of the hysteresis loop is higher than 30° C., the color state of the decolorable toner is unlikely to change between the first color state and the second color state according to the change of the human body temperature.

The exposing unit 26 faces the photoreceptor drum 25*a* of each of the image forming units 25Y, 25M, 25C, 25K, and 25D. The exposing unit 26 irradiates laser light based on image data on the surface of the photoreceptor drum 25*a* of each of the image forming units 25Y, 25M, 25C, 25K, and 25D. The exposing unit 26 thereby develops an electrostatic latent image on the surface of the photoreceptor drum 25*a* of each of the image forming units 25Y, 25M, 25C, 25K, and 25D. The image forming unit 25Y develops the electrostatic latent image generated by the laser light from the exposing unit 26 using a yellow toner. The image forming unit 25Y forms a yellow toner image on the surface of the photoreceptor drum 25*a*. The image forming unit 25M develops the electrostatic latent image generated by the laser light from the exposing unit 26 using a magenta toner. The image forming unit 25M forms a magenta toner image on the surface of the photoreceptor drum 25*a*. The image forming unit 25C develops the electrostatic latent image generated by the laser light from the exposing unit 26 using a cyan toner. The image forming unit 25C forms a cyan toner image on the surface of the photoreceptor drum 25*a*. The image forming unit 25K develops the electrostatic latent image generated by the laser light from the exposing unit 26 using a black toner. The image forming unit 25K forms a black toner image on the surface of the photoreceptor drum 25*a*. The image forming unit 25D develops the electrostatic latent image generated by the laser light from the exposing unit 26 using a decolorable toner. The image forming unit 25D forms a decolorable toner image on the surface of the photoreceptor drum 25*a*.

Each of the image forming units 25Y, 25M, 25C, 25K, and 25D transfers (primary transfer) the toner image on the surface of the photoreceptor drum 25*a* to the intermediate transfer belt 27. Each of the image forming units 25Y, 25M, 25C, 25K, and 25D provides a transfer bias to the toner image at respective primary transfer positions. Each of the image forming units 25Y, 25M, 25C, and 25K transfers the toner image of each color on the intermediate transfer belt 27 while overlaying the toner images. Each of the image forming units 25Y, 25M, 25C, and 25K forms the colored toner image on the intermediate transfer belt 27.

The transfer unit 28 transfers the toner image electrified on the intermediate transfer belt 27 to the surface of the sheet S at a secondary transfer position. The secondary transfer position is a position at which a supporting roller 28*a* and a secondary transfer roller 28*b* face against each other. The transfer unit 28 applies a transfer bias according to a level of a transfer current at the secondary transfer position. Then, the transfer unit 28 transfers the toner image on the intermediate transfer belt 27 to the sheet S by the transfer bias.

The fixing unit 29 includes a heating roller 29*b* in which a heating unit 29*a* is equipped and a pressurizing roller 29*c*. The pressurizing roller 29*c* is in contact with a fixing belt heated by the heating roller 29*b* in a pressed state. The fixing unit 29 fixes the toner image on the sheet S using heat and pressure applied to the sheet S.

The printing unit 3 includes a reversing unit 30. The reversing unit 30 reverses the sheet S discharged from the fixing unit 29 using a switchback mechanism of the reversing unit 30. The reversing unit 30 transfers the reversed sheet S to an entry side of the resist roller 24. The reversing unit 30 reverses the sheet S to form an image on the back surface of the sheet S for which the fixing process has been performed.

Figure 4:
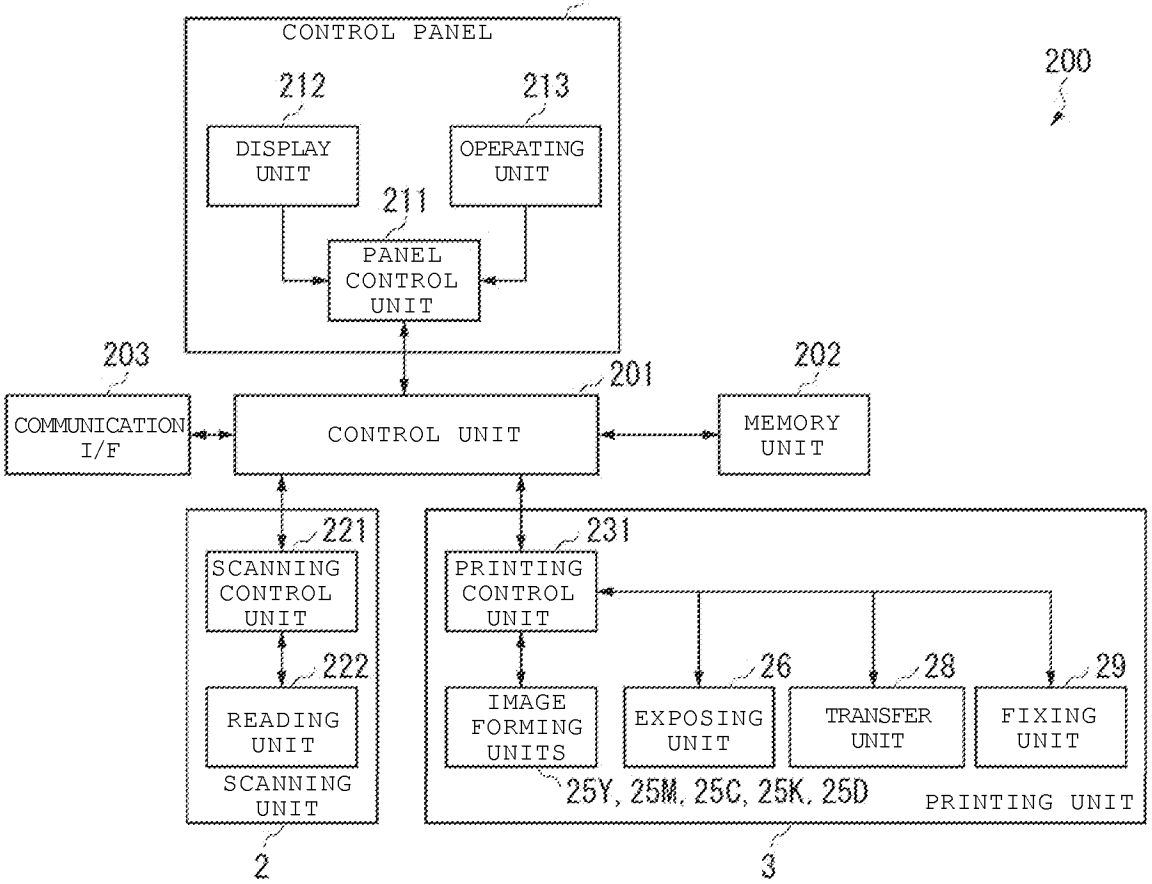
FIG. 4 is a block diagram of the image forming apparatus according to the embodiment.

Hereinafter, the configuration of the image forming apparatus 200 will be described with reference to FIG. 4. FIG. 4 is a block diagram of the image forming apparatus 200.

The control panel 1, the scanning unit 2, and the printing unit 3 are connected to the control unit 201. The control unit 201 controls each of the CPUs of the control panel 1, the scanning unit 2, and the printing unit 3. The control unit 201 controls the entire operation of the image forming apparatus 200. The control unit 201 includes a CPU, a ROM, and a RAM. The control unit 201 is connected to a memory unit 202 and a communication I/F 203.

The memory unit 202 stores the image data received from the scanning unit 2 or from an external device. The memory unit 202 is, for example, a hard disk device, a semiconductor memory, or the like.

The communication I/F 203 is a network device connected to the network 400.

The control panel 1 includes a panel control unit 211, a display unit 212, and an operating unit 213. The panel control unit 211 includes a CPU, a ROM, and a RAM. The panel control unit 211 controls the control panel 1.

The display unit 212 displays a screen corresponding to an operation on the operating unit 213 or an image corresponding to instruction from the panel control unit 211.

The operating unit 213 is operated by a user and outputs a signal indicating the operation content to the panel control unit 211. The operating unit 213 includes various keys.

The display unit 212 and the operating unit 213 may be integrally formed as a touch panel display.

The panel control unit 211 displays various kinds of information including the number of sheets S to be printed, the size of the sheets S, the type of the sheets S, or the like on the display unit 212. The operating unit 213 receives selection of information displayed on the display unit 212 and modification of the selection. The operating unit 213, for example, receives selection of the type of the sheet S. The operating unit 213 outputs the information indicating the type of selected sheet S to the printing unit 3.

The scanning unit 2 includes a scanning control unit 221 and a reading unit 222. The scanning control unit 221 includes a CPU, a ROM, and a RAM. The scanning control unit 221 controls scanning of an image by the reading unit 222.

The printing unit 3 includes a printing control unit 231. The printing control unit 231 includes a CPU, a ROM, and a RAM. The printing control unit 231 controls printing of an image on the sheet S by the printing unit 3. The printing control unit 231 writes various kinds of information designated by the control panel 1 in the RAM thereof. The ROM and RAM equipped in the printing control unit 231 stores data required for image printing. The data required for the image printing is font data of characters, certain pattern data, or the like. The font data of characters is, for example, a bit-mapped font of which the width is fixed, or the like. The bit-mapped font is font data in which shapes of characters are made into data as bitmap data. The certain pattern data is, for example, bitmap data including a fill pattern, a background pattern, a concealed pattern, and the like. The concealed pattern is, for example, a pattern of character array or the like.

Figure 5:
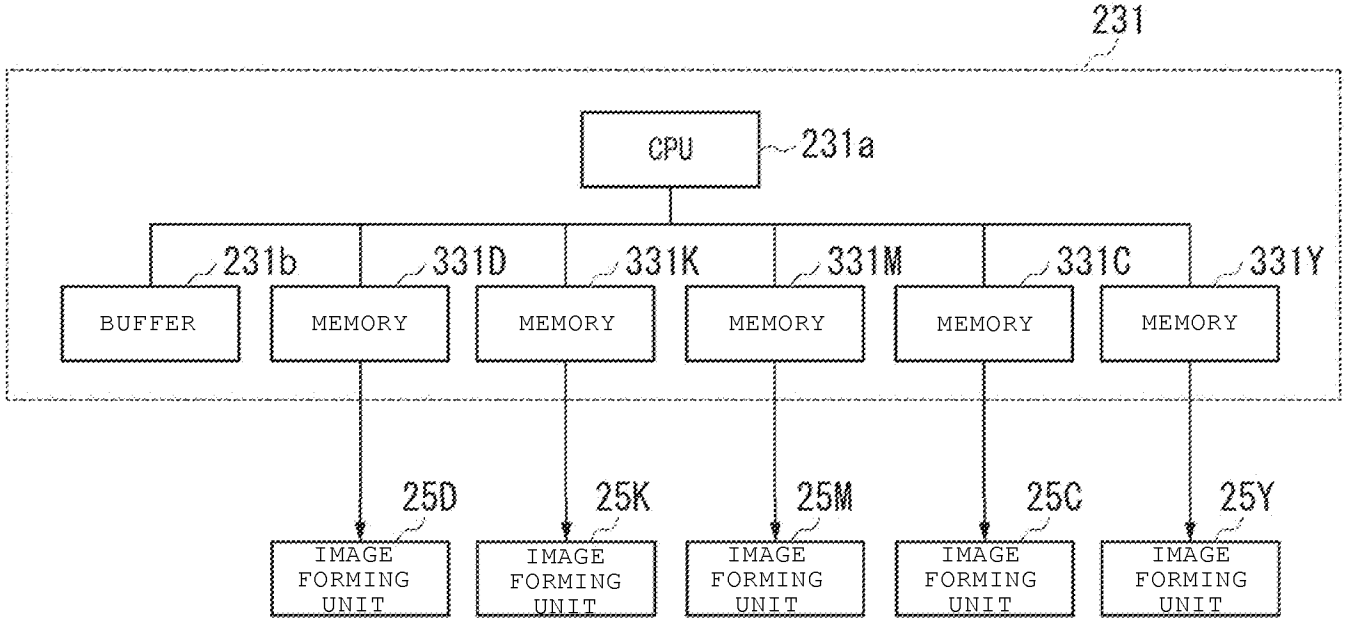
FIG. 5 is a block diagram of a printing unit of the image forming apparatus according to the embodiment.

FIG. 5 is a block diagram illustrating a part of the printing unit 3. The printing control unit 231 includes a CPU 231*a*, a buffer 231*b*, and a plurality of memories 231D, 231K, 231M, 231C, and 231Y. The memories 231D, 231K, 231M, 231C, and 231Y are connected to the image forming units 25D, 25K, 25M, 25C, and 25Y, respectively. The printing control unit 231 stores image data received from the terminal device 300 in the buffer 231*b*. The CPU 231*a* converts the image data stored in the buffer 231*b* into drawing data. The CPU 231*a* generates the drawing data in response to the instruction data from the terminal device 300. The CPU 231*a* stores the drawing data in at least one of the memories 231D, 231K, 231M, 231C, and 231Y in response to the image data and the instruction data. Each of the image forming units 25D, 25K, 25M, 25C, and 25Y forms an image on the sheet S by using the drawing data stored in the memories 231D, 231K, 231M, 231C, and 231Y, respectively.

Each of the memories 231D, 231K, 231M, 231C, and 231Y is, for example, a bitmap memory. Each of the memories 231D, 231K, 231M, 231C, and 231Y stores the drawing data in a bitmap in units of one pixel. Each of the memories 231D, 231K, 231M, 231C, and 231Y stores the drawing data in a bitmap corresponding to number of pixels output by the printing unit 3 on the sheet S. The drawing data is bitmap data. The drawing data includes character data formed by font data. The font data is, for example, a bit-mapped font of which the width is fixed, or the like.

Figures 6, 7:
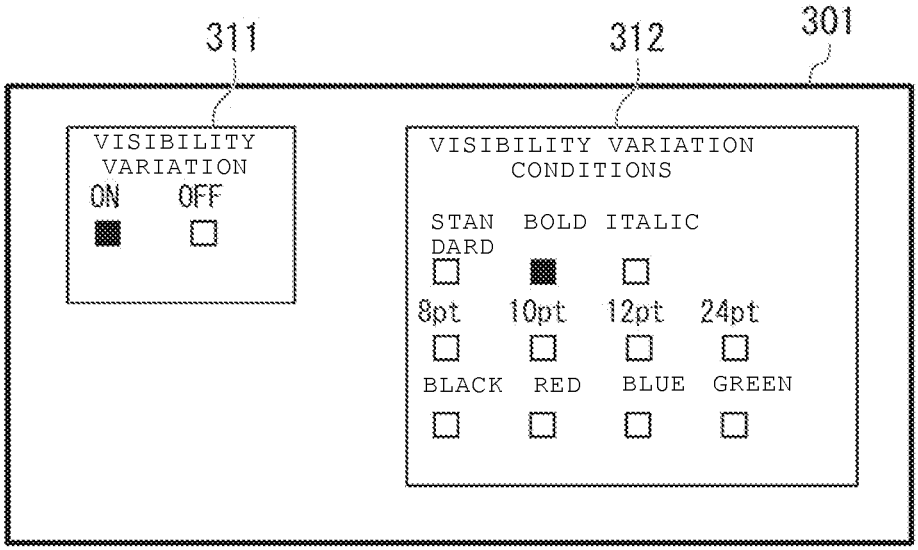
FIG. 6 illustrates an example of print data output by a terminal device of the image forming system according to the embodiment.
FIG. 7 illustrates an example of a screen displayed on the terminal device of the image forming system according to the embodiment.
Figure 8:
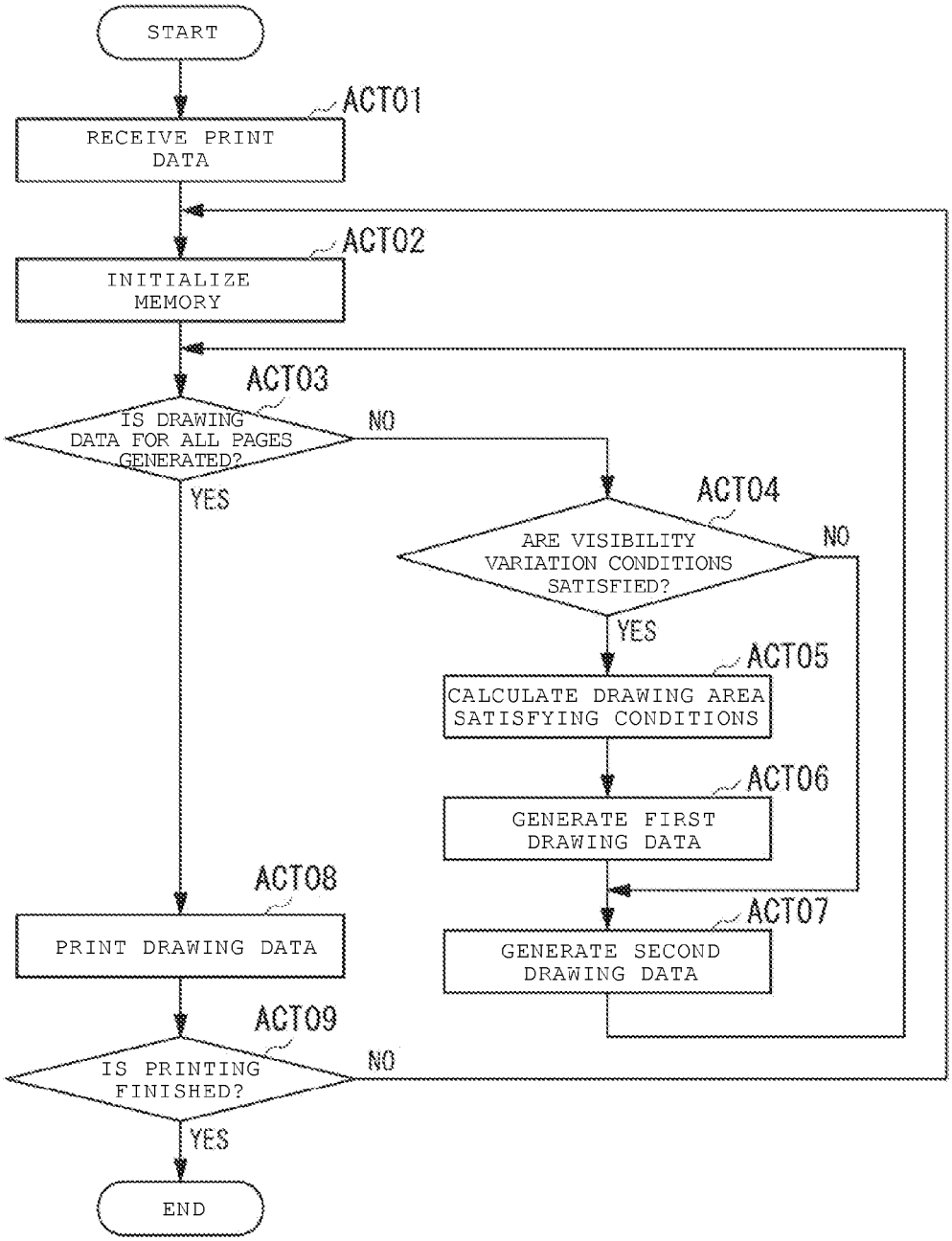
FIG. 8 is a flowchart illustrating an operation carried out by the image forming apparatus according to the embodiment.
Figure 9:
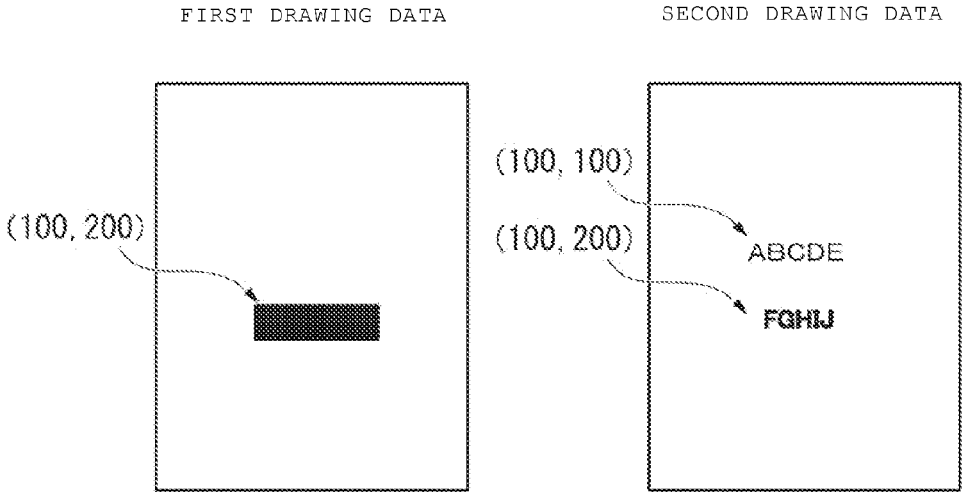
FIG. 9 illustrates an example of first drawing data to be printed and second drawing data to be printed by the printing unit of the image forming apparatus according to the embodiment.
Figure 10:
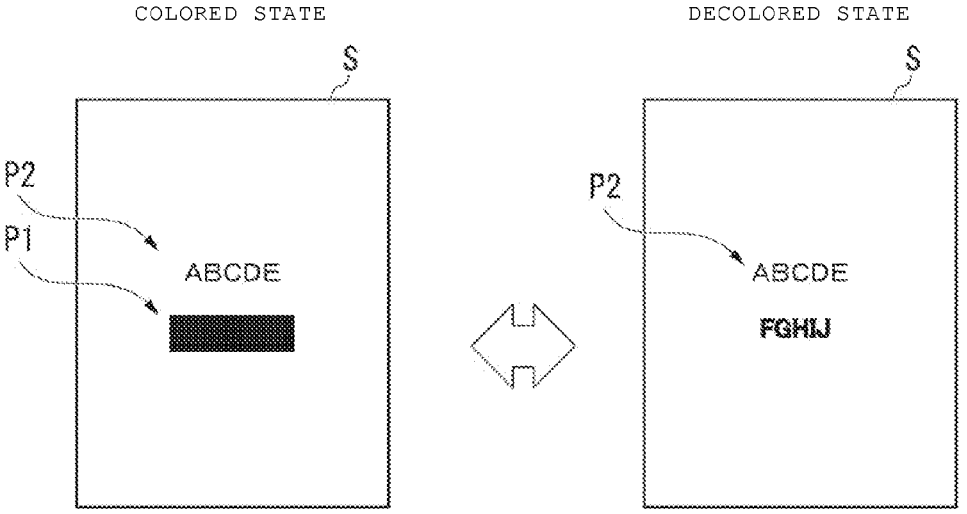
FIG. 10 illustrates an example of a printed image in a colored state of a decolorable toner and the printed image in a decolored state of the decolorable toner.

Hereinafter, the operation of the image forming system 100 will be described with reference to FIGS. 6-10. FIG. 6 illustrates an example of print data output by a terminal device 300. FIG. 7 illustrates an example of a display screen of the terminal device 300. FIG. 8 is a flowchart illustrating an example of an operation carried out by the image forming apparatus 200. FIG. 9 illustrates an example of first drawing data stored in the memory 231D and second drawing data stored in the memory 231K. FIG. 10 illustrates an example of an image formed on the sheet S when an image corresponding to the first drawing data is in a colored state and when the image is in a decolored state.

Hereinafter, an example of the operation by the terminal device 300 will be described.

The terminal device 300, for example, converts electronic data of a document created by a user or the like into data for printing using a print driver. The data for printing is, for example, print data including page description language (PDL) data. The PDL data instructs drawing of various data on a printing screen. The PDL data, for example, includes data of types of character data used for the printing, a drawing start position, text data that is drawn, or the like. The type of character data is, for example, a font, a size, a color of a character, or the like. The print data in FIG. 6 includes data of a font type (Times-New Roman), a size (10), and a drawing start position (100, 100) of text data (ABCD). The print data in FIG. 6 further includes data of a font type (Times-New Roman-Bold), a size (10), and a drawing start position (100, 200) of text data (FGHIJ). Times-New Roman is a font with a standard size. Times-New Roman-Bold is a bold font. The drawing start position (100, 100) and the drawing start position (100, 200) are coordinates that are set based on a certain standard position (0, 0) in a bitmap.

The terminal device 300 generates the instruction data related to image forming, which is set through a setting screen of the print driver or the like. The instruction data includes information of whether the visibility variation is set for the print data and information indicating conditions of the visibility variation target (visibility variation conditions) or the like. The visibility variation means that the visibility of an image formed on the sheet S by the printing unit 3 reversibly changes in accordance with the temperature change of the image.

As illustrated in FIG. 7, the setting screen 301 of the print driver includes a first selecting region 311 and a second selecting region 312. Through the first selecting region 311, whether the visibility variation in the print data is turned on or off can be set. The first selecting region 311 illustrated in FIG. 7 indicates that the visibility variation in the print data is turned on. Through the second selecting region 312, detailed setting for the visibility variation (setting of the visibility variation target) in the print data can be performed. Through the second selecting region 312, for example, a font, a size, a color of a character, or the like can be selected as the types of character data. The second selecting region 312 illustrated in FIG. 7 indicates that the character data with a bold font is set as the visibility variation target in print data. The setting information of the visibility variation is information that associates the data of the visibility variation target in the print data with the first drawing data (described below).

The terminal device 300, for example, transmits the print data, which is the image information, and the instruction data to the image forming apparatus 200.

Hereinafter, an example of the operation carried out by the image forming apparatus 200 will be described.

As illustrated in FIG. 8, the communication I/F 203 receives the print data and the instruction data from the terminal device 300 through the network 400 (ACT 01). The control unit 201 stores the print data and the instruction data received from the terminal device 300 in the buffer 231*b* of the printing control unit 231*b*.

The CPU 231*a* of the printing control unit 231 initializes the plurality of the memories 231D, 231K, 231M, 231C, and 231Y (ACT 02).

The CPU 231*a* determines whether the drawing data in page units is generated (ACT 03).

When the result of the determination is "NO" (ACT 03: NO), the process proceeds to ACT 04. On the other hand, when the result of the determination is "YES" (ACT 03: YES), the process proceeds to ACT 08.

The CPU 231*a* reads the print data and the instruction data stored in the buffer 231*b*. The CPU 231*a* determines whether the print data has data that satisfies the visibility variation conditions (ACT 04). The CPU 231*a*, for example, determines whether the print data has character data with a bold font corresponding to the visibility variation conditions set through the setting screen 301 illustrated in FIG. 7.

When the result of the determination is "NO" (ACT 04: NO), the process proceeds to ACT 07. On the other hand, when the result of the determination is "YES" (ACT 04: YES), the process proceeds to ACT 05.

The CPU 231*a* determines a drawing area that satisfies the visibility variation conditions based on the print data (ACT 05). The CPU 231*a*, for example, determines coordinate ranges of the visibility variation target (memory position) in the bitmap of each of the memories 231D, 231K, 231M, 231C, and 231Y. The CPU 231*a*, for example, determines the drawing area of the text data (FGHIJ) with a bold font as the visibility variation target based on the setting illustrated in FIG. 6. The CPU 231*a* reads the information of size of the text data (FGHIJ) from the ROM and the RAM of the printing control unit 231. The CPU 231*a* calculates the drawing area in a rectangular shape having a size that covers the text data (FGHIJ) by using the information of the size and the drawing start position (100, 200). The type of the character data, the drawing start position (100, 200), and the text data (FGHIJ) contained in the print data are area information for calculating the drawing area.

The CPU 231*a* generates first drawing data of a certain pattern to be printed in the drawing area of the visibility variation target (ACT 06). The CPU 231*a* reads bitmap data of the certain pattern from the ROM and the RAM of the printing control unit 231. The CPU 231*a* writes bitmap data of the certain pattern in the bitmap of the memory 231D of the image forming unit 25D in which the decolorable toner is used. The CPU 231*a* writes bitmap data of the certain pattern in the bitmap of the memory 231D corresponding to the drawing area of the visibility variation target. The CPU 231*a* generates the first drawing data in the memory 231D by writing the bitmap data of the certain pattern in the bitmap of the memory 231D. The first drawing data illustrated in FIG. 9 includes bitmap data of a fill pattern drawn in the drawing area in a rectangular shape that includes the drawing start position (100, 200).

The CPU 231*a* converts the print data into the second drawing data (ACT 07). The CPU 231*a* reads the font data corresponding to the type of character data contained in the print data from the ROM and the RAM of the printing control unit 231. The CPU 231*a* writes font data in each of the memories 231K, 231M, 231C, and 231Y corresponding to the colors instructed by the print data. The CPU 231*a* writes font data at the memory position instructed by the print data in the bitmap of each of the memories 231K, 231M, 231C, and 231Y. The CPU 231*a*, for example, writes font data in the memory 231K of the image forming unit 25K in which the non-decolorable black toner is used. The CPU 231*a* generates the second drawing data in the memory 231K by writing the font data of the characters in the bitmap of the memory 231K. The second drawing data illustrated in FIG. 9 includes the text data (ABCD) drawn at the drawing start position (100, 100) by the font data with a standard size. The second drawing data illustrated in FIG. 9 further includes the text data (FGHIJ) drawn at the drawing start position (100, 200) by the font data with a bold font.

The process returns to ACT 03 after ACT 07 is performed. The CPU 231*a* of the printing unit 3 operates to print the first drawing data and the second drawing data in page units on the sheet S (ACT 08). The CPU 231*a* operates to form an image based on the first drawing data and the second drawing data on the sheet S by each of the image forming units 25K and 25D, the exposing unit 26, the transfer unit 28, and the fixing unit 29. As illustrated in FIG. 10, the sheet S output from the printing unit 3 includes a first image P1 generated based on the first drawing data and a second image P2 generated based on the second drawing data. The first image P1 and the part of the second image P2 corresponding to the drawing area of the visibility variation target in the second drawing data overlap with each other. The first image P1 is formed with a decolorable toner, thus the color state thereof reversibly changes between the colored state and the decolored state in response to the temperature change. The second image P2 is formed with a non-decolorable toner, thus maintains the colored state regardless of the temperature change. In the overlapping area of the first image P1 and the second image P2, the visibility of the second image P2 is lowered when the first image P1 changes from the decolored state to the colored state. In the overlapping area of the first image P1 and the second image P2, the visibility of the second image P2 is recovered when the color state of the first image P1 changes from the colored state to the decolored state. On the sheet S illustrated in FIG. 10, the data (FGHIJ), which is the visibility variation target of the second image P2, is concealed by the first image P1 at the temperature lower than the human body temperature. On the sheet S illustrated in FIG. 10, the data (FGHIJ of the second image P2 concealed by the first image P1 appears at the temperature equal to or higher than the human body temperature.

The CPU 231*a* determines whether the entire output of the print data is finished (ACT 09).

When the result of the determination is "NO" (ACT 09: NO), the process proceeds to ACT 02.

On the other hand, when the result of the determination is "YES" (ACT 09: YES), the CPU 231*a* finishes the process.

The image forming apparatus 200 according to the embodiment described above has the CPU 231*a* that operates such that the first image P1 and the second image P2 overlaps in accordance with the visibility variation conditions. Thus, it is possible to easily change the visibility of the second image P2. As the color state of the first image P1 reversibly changes in accordance with the temperature, the visibility of the second image P2 changes accordingly. For example, when confidential information or the like in documents is the second image, it may be able to prevent the confidential information from being copied by concealing confidential information with the first image. For example, when the important word of a teaching material or the like becomes the visibility variation target, it is possible to use the teaching material as a workbook (practice quiz). As the visibility of the second image P2 changes between a temperature range equal to or higher than the human body temperature and a temperature range equal to or lower than the human body temperature, it is possible to change the visibility of the second image P2 by simply touching the second image P2 by a user. Further as the temperature range of the hysteresis loop of the decolorable toner is 30° C. or lower, the color state of the first image P1 is likely to reversibly change depending on whether or not a human body touches the first image P1. When the temperature range of the hysteresis loop of the decolorable toner is higher than 30° C., the color state of the first image P1 is unlikely to reversibly change by the touch of the human body. The second image P2 maintains the colored state. As a result, when the color state of the first image P1 changes, the second image P2 can be recognized.

The image forming system 100 according to the embodiment described above includes the terminal device 300 through which the visibility variation conditions can be set. As a result, usability of the function can be improved.

Hereinafter, a modification example of the above embodiment will be described.

Figure 11:
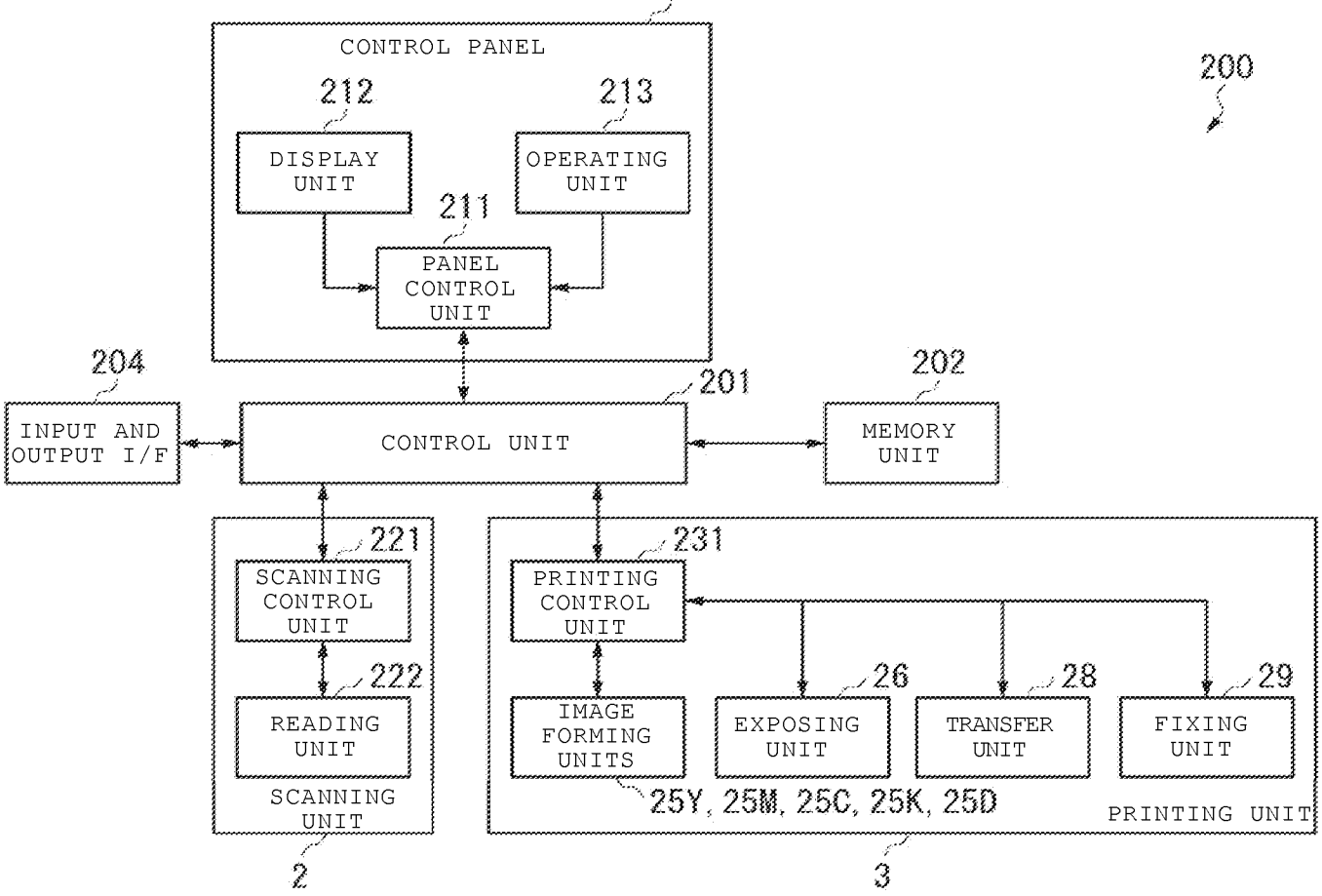
FIG. 11 is a block diagram of an image forming apparatus according to a modification example of the embodiment.

FIG. 11 is a block diagram of the image forming apparatus 200 according to the modification example.

The image forming apparatus 200 according to the embodiment described above receives image data from the terminal apparatus 300 which is connected through the network 400; however, the image data may be received in a different manner. For example, the image forming apparatus 200 of the modification example may receive image data from the terminal device 300 directly connected by a cable or the like.

The image forming apparatus 200 of the modification example may include an input and output I/F 204, as illustrated in FIG. 11. The input and output I/F 204 is a terminal or the like that connects a memory device including a terminal for connection including a cable for connecting outer devices including the terminal device 300, a USB flash drive, or the like. The image forming apparatus 200 of the modification example may obtain image data from a memory device including a USB flash drive or the like which is connected to the input and output I/F 204.

The image forming apparatus 200 according to the embodiment described above receives instruction data related to image forming from the terminal device 300; however, the instruction data may be received in a different manner. For example, the image forming apparatus 200 according to the modification example may generate the instruction data related to image forming by the control panel 1. Alternatively, the image forming apparatus 200 according to the modification example may generate the instruction data related to image forming by using the setting screen displayed on the display unit 212 of the control panel 1.

The image forming apparatus 200 according to the embodiment described above includes the plurality of the image forming units 25Y, 25M, 25C, and 25K in which the decoloring toners of a plurality of colors are used; however, the configuration of the image forming apparatus 200 is not limited thereto. For example, the image forming apparatus 200 of the modification example may be a monochromatic image forming apparatus including any one among the plurality of the image forming units 25Y, 25M, 25C, and 25K.

In the image forming apparatus 200 according to the embodiment described above, the color in the colored state of the decolorable toner is a color that is same as or denser than the decolorable black toner; however the configuration is not limited thereto. For example, the color in the colored state of the decolorable toner may be a color other than black.

In the image forming apparatus 200 according to the embodiment described above, the second color state of the decolorable toner is the decolored state where the coloring is not performed by a coloring agent; however the configuration is not limited thereto. For example, in the image forming apparatus 200 of the modification example, the color state is, for example, at least one of brightness, hue, and intensity. In the first color state and the second color state, at least one of brightness, hue, and intensity may be different. The second color state may be a color different from the color of the sheet S (including a chromatic color along with achromatic colors including white, black, and the like).

The image forming apparatus 200 according to the embodiment described above prints the second drawing data with a bold font when the visibility variation condition is a bold font; however the configuration is not limited thereto. For example, the image forming apparatus 200 according to the modification example may print the second drawing data with a standard font when the visibility variation condition is a font which is more emphasized than the standard font.

In the embodiment described above, in the overlapping area of the first image P1 and the second image P2, the first image P1 may be printed over the second image P2, and the second image P2 may be printed over the first image P1. By printed the first image P1 over the second image P2, the concealment of the second image P2 may be increased compared to when the second image P2 is printed over the first image P1.

The image forming apparatus 200 according to the embodiment described above calculates the drawing area of the visibility variation target based on the type of character data, the drawing start position, and the like; however the configuration is not limited thereto. For example, in the image forming system 100 according to the modification example, the print data may include area information of the drawing area of the visibility variation target. Alternatively, the terminal device 300 according to the modification example may prompt a user to directly set the drawing area of the visibility variation target by using a preview screen of the data for printing.

The image forming apparatus 200 according to the embodiment described above, when the printing output and the resolution of the drawing position designation are different from that of the font data, may perform a process including power varying between each data.

In the embodiment described above, each CPU of the image forming apparatus 200 may function by executing a program. The program may be recorded in a computer-readable recording material and transmitted through an electric communication circuit. The recording material is, for example, a portable medium including a flexible disk, a magneto-optical disk, a ROM, a CD-ROM, or the like, a memory device including a hard disk equipped in a computer system, or the like.

In the embodiment described above, apart or the entirety of each CPU function of the image forming apparatus 200 may be achieved by hardware. The hardware is, for example, large scale integration (LSI), application specific integrated circuit (ASIC), programmable logic device (PLD), or field programmable gate array (FPGA).

According to at least one of the embodiments described above, as the image forming apparatus has the CPU 231*a* that operates such that the first image P1 and the second image P2 are overlapped in accordance with the visibility variation conditions, it is possible to easily change the visibility of the second image P2. It is possible to improve convenience by widening the possibility of usage of the sheet S on which the first image P1 generated by the toner of which the color is reversibly changed and the second image P2 generated by the toner of which the color is irreversibly changed are overlapped.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a first image forming unit configured to forma first image with a decolorable material, a color state of the decolorable material changing from a first color state to a second color state when a temperature thereof increases from a room temperature to a human body temperature, and from the second color state to the first color state when the temperature thereof decreases from the human body temperature to the room temperature; and a second image forming unit configured to form a second image with a non-decolorable material, the first image overlapping with at least a portion of the second image.

2. The image forming apparatus according to claim 1, wherein the overlapped portion of the second image is unrecognizable when the first image is in the first color state, and recognizable when the first image is in the second color state.

3. The image forming apparatus according to claim 2, wherein the second color state is an achromatic state, and the first color state is a chromatic state.

4. The image forming apparatus according to claim 1, wherein the overlapped portion of the second image is recognizable when the first image is in the first color state, and unrecognizable when the first image is in the second color state.

5. The image forming apparatus according to claim 4, wherein the first color state is an achromatic state, and the second color state is a chromatic state.

6. The image forming apparatus according to claim 1, further comprising:

a control unit configured to determine whether or not image data of each portion of an image to be printed satisfy a predetermined condition, and when image data of a portion of the image to be printed satisfy the predetermined condition, control the second image forming unit to form the image to be printed with the non-decolorable material, as the second image, and the first image forming unit to form an image that overlaps with the portion of the image with the decolorable material, as the first image.

7. The image forming apparatus according to claim 6, wherein the control unit is further configured to control the second image forming unit to form the image to be printed with the non-decolorable material, when none of the image data are determined to satisfy the predetermined condition.

8. The image forming apparatus according to claim 6, wherein the predetermined condition is satisfied when at least one of a font, a size, and a color of a portion of the image to be printed is a predetermined font, size, and color, respectively.

9. The image forming apparatus according to claim 6, further comprising:

an operation unit configured to receive a user command to set the predetermined condition.

10. The image forming apparatus according to claim 6, further comprising:

a communication unit configured to receive a user command to set the predetermined condition from an external device.

11. A method for forming an image, comprising:

forming a first image with a decolorable material, a color state of the decolorable material changing from a first color state to a second color state when a temperature thereof increases from a room temperature to a human body temperature, and from the second color state to the first color state when the temperature thereof decreases from the human body temperature to the room temperature; and forming a second image with a non-decolorable material, the first image overlapping with at least a portion of the second image.

12. The method according to claim 11, wherein the overlapped portion of the second image is unrecognizable when the first image is in the first color state, and recognizable when the first image is in the second color state.

13. The method according to claim 12, wherein the second color state is an achromatic state, and the first color state is a chromatic state.

14. The method according to claim 11, wherein the overlapped portion of the second image is recognizable when the first image is in the first color state, and unrecognizable when the first image is in the second color state.

15. The method according to claim 14, wherein the first color state is an achromatic state, and the second color state is a chromatic state.

16. The method according to claim 11, further comprising:

determining whether or not image data of each portion of an image to be printed satisfy a predetermined condition, wherein when image data of a portion of the image to be printed satisfy the predetermined condition, the image to be printed is formed with the non-decolorable material as the second image, and an image that overlaps with the portion of the image is formed with the decolorable material as the first image.

17. The method according to claim 16, wherein the predetermined condition is satisfied when at least one of a font, a size, and a color of a portion of the image to be printed is a predetermined font, size, and color, respectively.

18. The method according to claim 16, further comprising:

receiving a user command to set the predetermined condition.

19. An image forming apparatus comprising:

a first image forming unit configured to forma first image with a decolorable material, a color state of the decolorable material starting to change from a first color state to a second color state when a temperature thereof exceeds a first temperature, and from the second color state to the first color state when the temperature thereof falls below a second temperature that is lower than the first temperature, the first and second temperatures being between 25° C. and 35° C.; and a second image forming unit configured to form a second image with a non-decolorable material, the first image overlapping with at least a portion of the second image.

* * * * *